US006579412B2

(12) United States Patent
Sundaram et al.

(10) Patent No.: US 6,579,412 B2
(45) Date of Patent: Jun. 17, 2003

(54) PROCESS FOR OZONE BLEACHING OF LOW CONSISTENCY PULP

(75) Inventors: V. S. Meenakshi Sundaram, Bur Ridge, IL (US); Derek Hornsey, Beaconsfield (CA); Sebastien Corbeil, Willowbrook, IL (US)

(73) Assignees: L'Air Liquide - Societe' Anonyme a' Directoire et Conseil de Surveillance pour l'Etude et l'Exploitation des Procedes Georges Claude, Paris; American Air Liquide LP, Fremont, CA (US)

( * ) Notice: Subject to any disclaimer, the term of this patent is extended or adjusted under 35 U.S.C. 154(b) by 0 days.

(21) Appl. No.: 10/201,248

(22) Filed: Jul. 24, 2002

(65) Prior Publication Data

US 2003/0006017 A1 Jan. 9, 2003

Related U.S. Application Data

(63) Continuation of application No. 09/559,993, filed on Apr. 27, 2000, now abandoned, which is a continuation of application No. 09/074,517, filed on May 8, 1998, now abandoned.

(51) Int. Cl.[7] ..... D21C 9/14; D21C 9/153

(52) U.S. Cl. ..... 162/57; 162/65; 162/88

(58) Field of Search ..... 162/57, 65, 66, 162/88, 89, 52

(56) References Cited

U.S. PATENT DOCUMENTS

| | | | | | |
|---|---|---|---|---|---|
| 4,842,690 | A | * | 6/1989 | Gazdik et al. | 162/57 |
| 5,346,588 | A | * | 9/1994 | Sixta et al. | 162/65 |
| 5,656,130 | A | | 8/1997 | Ali | |
| 5,728,264 | A | | 3/1998 | Pangalos | |
| 5,853,536 | A | * | 12/1998 | Hornsey et al. | 162/65 |

FOREIGN PATENT DOCUMENTS

| | | | | |
|---|---|---|---|---|
| CA | 2078276 | * | 3/1994 | 162/65 |
| WO | 93/15264 | * | 3/1994 | 162/65 |

* cited by examiner

*Primary Examiner*—Steve Alvo
(74) *Attorney, Agent, or Firm*—Linda K. Russell

(57) ABSTRACT

Provided is a process for bleaching pulp with ozone. The process involves preparing a slurry of cellulosic pulp having a consistency in fibers of from 1–5 weight %. Such a low consistency slurry is then mixed with ozone under high shear conditions. The ozone is then maintained in contact with the cellulosic fibers to effect bleaching of the fibers. The present process offers the advantages of bleaching using a low consistency slurry, with the added advantages of employing ozone.

18 Claims, 7 Drawing Sheets

PROCESS FOR OZONE BLEACHING OF LOW CONSISTENCY PULP

This application is a continuation of application Ser. No. 09/559,993, filed on Apr. 27, 2000, now abandoned, which is a continuation of application Ser. No. 09/074,517, filed on May 8, 1998, now abandoned.

BACKGROUND OF THE INVENTION

1. Field of the Invention

The present invention relates to a method for bleaching pulp. More specifically, the present invention relates to a method of bleaching pulp using ozone in which the ozone is more effectively dispersed and dissolved in a low consistency pulp.

2. Brief Description of the Prior Art

During the past 10–15 years the bleaching of pulp in the Kraft Process has undergone many changes. These changes were mainly prompted by environmental concerns of the quality of the effluent being discharged from paper mills. Of main concern was the bleach plant effluent, which contained polychlorinated dibenzodioxines and dibenzofurans among other compounds. The measurement of AOX was used as an indicator of the concentration of these compounds and the test was quickly adopted as a standard for legislation.

It was soon determined that the chlorine used in bleaching was a factor in high AOX values, while values could be reduced by lowering the quantity of chlorine used. Chlorine dioxide was substituted for chlorine and reduced AOX values was the result. A typical bleaching sequence became C/D.Eo.D.E.D. with at least 50% of the chlorine being replaced by chlorine dioxide on an equivalence basis. Some paper mills have eliminated chlorine entirely by using D.Eo.D.E.D. or O.D.Eo.D.E.D. sequences.

Ozone is a powerful bleaching agent used in many bleach plants throughout the world to bleach Kraft Pulp and recycled fibers. It has recently been discovered that ozone can replace chlorine dioxide and achieve the same brightness and pulp quality. It has been found that 1 kg of ozone can essentially replace $2_{-4\ kgClO2}$. This results in lower cost bleaching sequences such as O.Z/D.Eop.D.E.D, O.D/Z.Eop.D.X.D, D/Z.Eop.D.E.D. and others. The use of ozone ($O_3$) can become more attractive, however, if a more efficient and cost effective method can be found to better disperse and dissolve $O_3$ into an existing bleaching sequence. The usual method of bleaching with ozone comprises dispersing ozone into a medium consistency pulp using a pump, mixer and retention tube. This is carried out at a pressure of 150 psig and requires a compressor to add the ozone.

Medium consistency pulp generally contains a cellulose fiber suspension of from 8–15%, that when exposed to high shear forces acquires fluid properties that permits it to be pumped. High shear mixers enable gases to be dispersed and dissolved in medium consistency pulps.

A typical medium consistency ozone bleaching process generally consists of pumping pulp to a mixer where ozone is added. The gas dispersion in the pulp is then sent to a vertical retention tube where at least 90% of the ozone dissolves and reacts during a hydraulic residence time of 3060 secs. If the ozone utilization is low, then a second mixer may be added. On discharge from the retention tube, gas is separated from the pulp and the excess ozone in the gas is sent to an ozone destruct unit.

To achieve high utilization of ozone in medium consistency bleaching, a pump and mixer(s) are used that are driven by high HP motors and the power requirement can reach 0.5–1.0 HP/ton pulp/day. Typically pulp is bleached with an ozone charge of about 5 kg ozone/ton pulp, and this is added in a single stage. If higher charges of ozone are required then more than a single stage is necessary, e.g. 10 kg/ton requires two stages. The limiting factor in ozone addition is the volume of gas that can be dispersed and dissolved in the pulp with high ozone utilization. For medium consistency processes it has been found that a high utilization of ozone can be achieved if the volume ratio of gas in the total fluid mixture does not exceed 30%. For ozone generated at a concentration of 10% w/w and operating at a pressure of 150 psig, the maximum charge added is 5 kg of ozone/ton of pulp. If the ozone concentration is raised to 12% this charge can be raised to 6 kg/ton with the same ozone utilization.

An alternative to medium consistency pulp technology is that of using high consistency pulp. In this process fibers are dewatered to a consistency of 25–40% by passing medium consistency pulp through a press. As well as dewatering the fibers, the pulp is compressed and then fluffed in order to have good contact between gas and fibers. The pulp is then introduced into a reactor where it is contacted with ozone for a period of 1–3 minutes at a pressure of 5 psig. After ozonation, the pulp is degassed and diluted with wash water before passing on to a washing stage.

When this process was first started there were reports of uneven bleaching, but with improved reactor design this was overcome. An advantage of this process is that it does not require high concentrations of ozone, as using 6.0% w/w works very well. However the high consistency process is not widely accepted because of the mechanical complexity of the equipment and the high power requirement for dewatering the pulp.

Another possible technique for bleaching pulp involves low consistency pulp. Low consistency pulp employs a cellulose fiber suspension of 1–5% that has a viscosity greater than water, but can be pumped using conventional pumps without the need of a high shearing effect. Chlorination is generally carried out in a low consistency process and in many processes chlorine dioxide is also added to low consistency pulp slurries. However there has been little discussion of ozonation at low consistency.

Laboratory studies have been carried out on ozonating pulp in bubble columns using pulp slurries around 0.5% concentration. This method worked well, but with columns of a height of 25 m, the gas residence time was very short and ozone utilization low. Furthermore, ozone concentrations in the gas applied were low, 2–3% w/w.

This low concentration required large volumes of gas to obtain the desired ozone charge. The low concentration also led to low mass transfer rates. The net effect of this was poor ozone utilization, and this together with the dilute pulp slurry has made the consideration of using ozone with low consistency pulp commercially unattractive.

Up to this point, therefore, there has been no commercial process devoted to ozone bleaching of low consistency pulp. While some laboratory studies have been carried out at consistencies of about 0.5% using unpacked columns and adding the ozone by a diffuser at the bottom, such a process is not considered to be practical for commercial use. Furthermore, there are reports that $O_3$ consumption increases due to decomposition in water. Also the favored technology for bleaching uses medium consistency pulps and there have been no reported attempts to carry out low consistency ozone bleaching on an industrial scale.

Low consistency pulp, however, is easier to pump. Dispersing ozone onto it, because of its low viscosity, would therefore require less power. This can be done before or after a low consistency D stage or a medium consistency D stage. In the latter case this is carried preferably out in a downflow tower and at the bottom of the tower the pulp is diluted to low consistency in order to pump it to the next process step.

Hence if ozone can be effectively and efficiently dispersed and dissolved in low consistency pulp, the use of low consistency technology with ozonation offers a low cost method which can be used to retrofit an existing bleaching process.

Therefore, it is an object of the present invention to provide a novel process and apparatus for bleaching pulp using ozone.

Another object of the present invention is to provide a method for more effectively and efficiently dispersing and dissolving ozone into low consistency pulp so as to make low consistency pulp bleaching technology with ozone viable.

Still another object of the present invention is to provide an efficient process and apparatus for bleaching employing low consistency technology, whereby ozone is used as the bleaching agent.

These and other objects of the present invention will become apparent to the skilled artisan upon a review of the following disclosure, the Figures of the Drawing, and the claims appended hereto.

SUMMARY OF THE INVENTION

In accordance with the foregoing objectives, there is provided a novel process and apparatus for bleaching pulp with gaseous mixtures comprising ozone. The process of the present invention comprises first preparing a slurry of cellulosic pulp of a low consistency, i.e., a consistency of fibers of from about 1–5 weight %. Ozone is then mixed with the pulp slurry using high shear mixing. This high shear is preferably created using a mixer designed for medium consistency pulp bleaching, i.e., a mixer generally used for medium consistency pulps. Such high shear (high-intensity) mixers are well known in the art. Using the high shear mixing has been found to allow the ozone to be effectively and efficiently dispersed and dissolved into the low consistency pulp, even while the pulp mixture remains at low pressure. The ozone is then maintained in contact with the cellulosic fibers for a time sufficient to bleach the fibers, before separation occurs.

The process of the present invention offers one the energy benefits of using low consistency technology, in combination with the benefits of using ozone to bleach the cellulosic pulp. The ozone bleaching step of the present invention can be combined in an overall bleaching process with other bleaching steps. For example, the ozone bleaching step can be used either before or after a chlorine dioxide bleaching step. The ozone bleaching step can also be followed by a different bleaching step, e.g., with hydrogen peroxide.

Another advantage of the present invention is that when ozone is compressed at higher pressures, it breaks down to oxygen ($O_2$). Thus, if a lower pressure can be used, more ozone should be available. Ozone also has a short half-life before converting to oxygen, therefore, the present invention with its short mixing time helps ensure more ozone is available for bleaching purposes.

In another embodiment, there is provided a system for a reactor for bleaching pulp at low consistency with ozone. The reactor comprises a high shear mixer wherein ozone is dispersed into a pulp slurry having a consistency in the range of from 1 to 5 wt %, and a retention tube connected to the mixer which operates at a pressure of from 20 to 60 psig, and wherein the ozone bleaches the pulp in the pulp slurry.

DETAILED DESCRIPTION OF THE PREFERRED EMBODIMENTS

Figure 1:
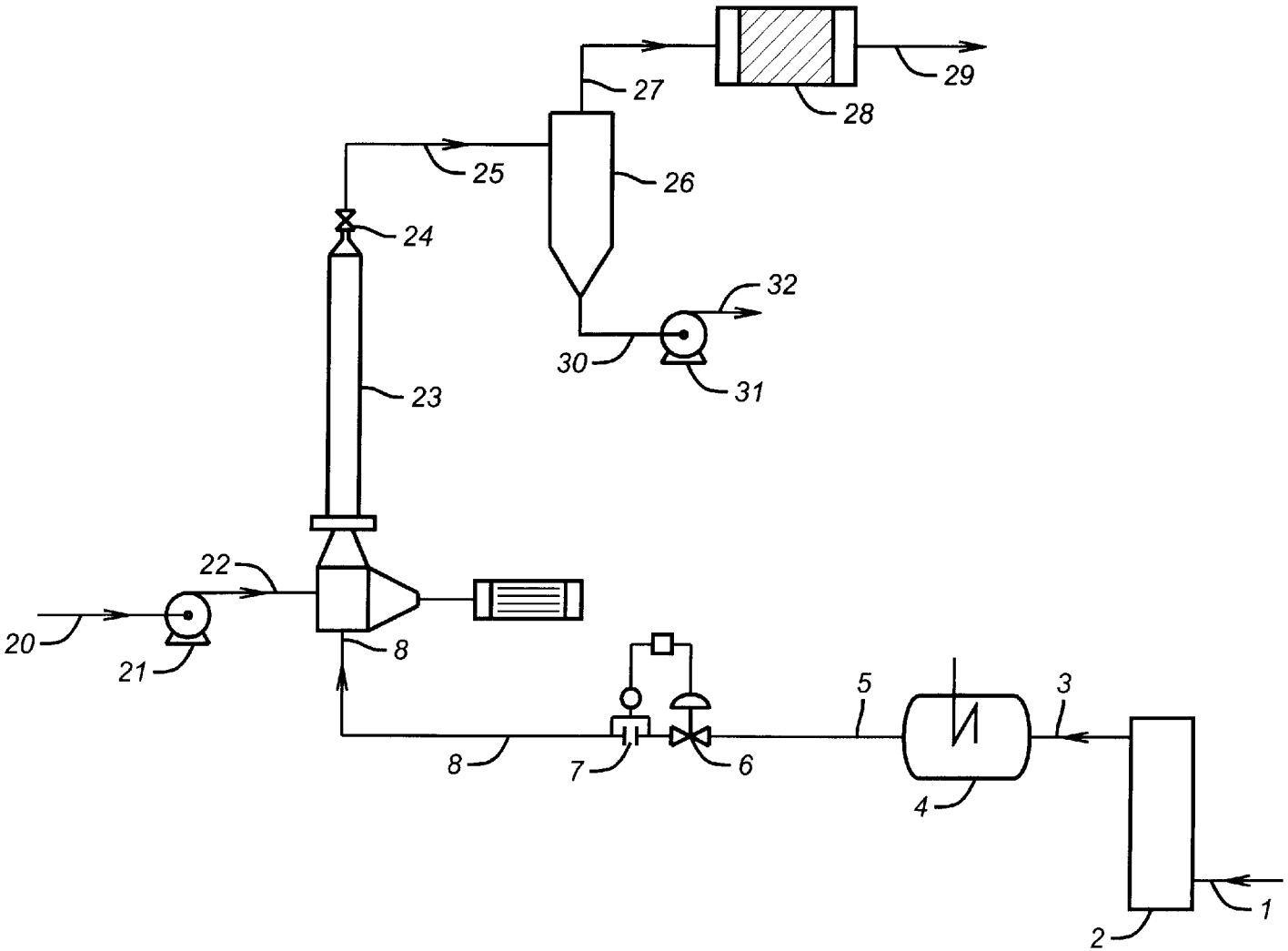
FIG. 1 of the Drawing depicts a reactor for bleaching pulp at low consistency with ozone, which uses a pressurized ozone generator.

The ozone employed in the process of the present invention can be of any source. Preferably, the ozone is generated on-site using an ozone generator, to thereby produce ozone from oxygen at a concentration in the range of from about 5 to 20 wt %, more preferably in the range of from about 10 to 20 wt %, and most preferably in the range of from about 10 to 15 wt %. Ozone generators are well known, and are generally operated at a pressure in the range of from about 20–60 psig, and more preferably in the range of from 30–40 psig.

The ozone/oxygen mixture is preferably introduced into the high shear mixer through a valve, which can be used to control the flow of the gas mixture into the high shear mixer. The ozone/oxygen gas mixture can be compressed, if so desired, prior to introduction into the high shear mixer. The ozone compressor generally operates at a pressure ranging from 20–150 psig, and more preferably in the range of from 30–40 psig.

The high shear mixer can be any high shear mixer well known to the art of pulp bleaching. Such mixers are described, for example, in Pulp Bleaching—Principals and Practice by Carlton W. Dence and Douglas W. Reeve, TAPPI Press, 1996, pages 549–554. In high shear (high intensity) mixers, the pulp and ozone gas mixture are mixed by passage through zones of intense shear. They induce microscale mixing in the entire volume and not only in specific locations as in a continuous stirred reactor. The high shear is created by imposing high rotational speeds across narrow gap, generally between the rotor blades and reactor casing, through which the pulp suspension flows. Although there are design differences among the high shear mixers conventionally known, they all attempt to fluidize the suspension in the mixture working zone. The high shear rate insures flock disruption and good fiber scale mixing.

The present invention employs a high shear mixer, and many different high shear mixers used for pulp bleaching are known. Some of those known include the Ahlstrom Ahlmix, the Ahlstrom MC pump, the Beloit-Rauma R series, the Ingersoll-Rand Hi-Shear and the Impco Hi-Shear mixer from Beloit Corporation. Others include the Kamry MC, the Kamry MC Pump (Pilot) the Sunds SM and Sunds T mixers. The Quantum mixer is also an acceptable high shear mixer. All such mixers are known in the art and are generally used to mix medium consistency pulp suspensions.

Mixers can be compared based on energy applied (MJ/ton of pulp) and power dissipation ($W/m^3$). J. R. Bourne in *Chem. Eng. Sci.,* 38(1):5 (1983) states that all devices operated at the same power unit volume will generate the same rate of micromixing. This assumes energy applied equals energy dissipated, which is not true for all mixers. The distribution of power throughout the suspension is as important as its total. Examples of different mixers and the energy and power values for a given pulp consistency are as follows:

| Mixer Type | Consistency (wt %) | Power Dissipation ($W/m^3$) | Energy (MJ/ton) |
|---|---|---|---|
| Hand Mixing | 3 | $2 \times 10^4$ | 120 |
| CSTR | 2–3 | 600 | 5–9 |
| Quantum (high shear) Mixer | 5 | $4.5 \times 10^5$ | 63 |
| High Shear | 10 | $1.8 \times 10^6$ | 180 |

Using the measured energy dissipation rate and a correlation for the apparent viscosity of a pulp suspension given by Bennington in "Mixing Pulp Suspensions", PhD. thesis, The University of British Columbia, Vancouver, B.C., 1988, $\tau$ is 0.02 sec. for a 10% consistency in a typical high shear mixer. In a CSTR operating at 3% consistency, $\tau$=0.4 sec., but varies locally with the mixer. $\tau$ represents the mean lifetime of turbulent eddies.

The pulp suspension of the present invention that is provided to the high shear mixer is of low consistency. This means that the amount of pulp contained in the suspension ranges from about 1 to 5 wt %. More preferably, the amount of pulp in the suspension ranges from 2 to 4 wt %. Preferably, the temperature of the pulp slurry entering the mixer is in the range of from about 20–80° C., more preferably from about 40–60° C. The ozone charge added to the pulp is in the range of from about 2–10 kg/ton, more preferable from about 5–6 kg/ton.

Once in the high shear mixer, the ozone and pulp suspension are mixed in the high shear mixer in the range of from about 0.01 seconds to 10 seconds, and more preferably in the range of from about 0.1 seconds to 4 seconds. Once the mixing has taken place, the pulp suspension is then passed to a bleaching or reactor station, which is preferably a retention tube, wherein the residence time ranges from about 1 to 10 minutes, more preferably from about 2–5 minutes. It is in the retention tube that the bleaching of the pulp actually takes place by the ozone. Because of the use of the high shear mixer, and the short time in which it takes to dissolve the ozone, as well as the low pressures under which the mixing and retention tube can operate, more ozone is available to do the bleaching of the low consistency pulp. Accordingly, the present invention provides surprising results with regard to excellent bleaching.

Referring to FIG. 1, there is illustrated a reactor for bleaching pulp at low consistency with ozone by using a pressurized ozone generator. It consists of a medium consistency mixer where ozone is dispersed in the low consistency pulp followed by a retention tube operating at a pressure between 20–60 psig where ozone gradually dissolves and bleaches the pulp.

Air is introduced by line 1 into an air separation unit 2 where oxygen is separated from air. Oxygen passes by line 3 into an ozone generator 4 and is converted to ozone, and this passes through line 5 into a control valve 6 that automatically regulates the gas flow by gas flowmeter 7. Ozone gas is introduced to the mixer 9 by an inlet line 8 and is dispersed into the low consistency pulp. Pulp slurry passes through line 20 into pump 21 where it is pumped into the mixer 9 and mixed with the ozone-oxygen mixture.

The pulp slurry-gas mixer passes into the column 23 that is held under pressure by a back pressure valve 24. The ozone-oxygen mixture dissolves and reacts with the pulp slurry before exiting through valve 24 into line 25.

The pulp slurry-gas mixture flows into a separator vessel 26 where gases are separated from the pulp and flow through line 27 into an ozone destruct unit 28, where the ozone is destroyed and the remaining gases leave through line 29. The pulp slurry leaves the separator through line 30 and flows into pump 31 where it is pumped to the next stage through line 32.

Figure 2:
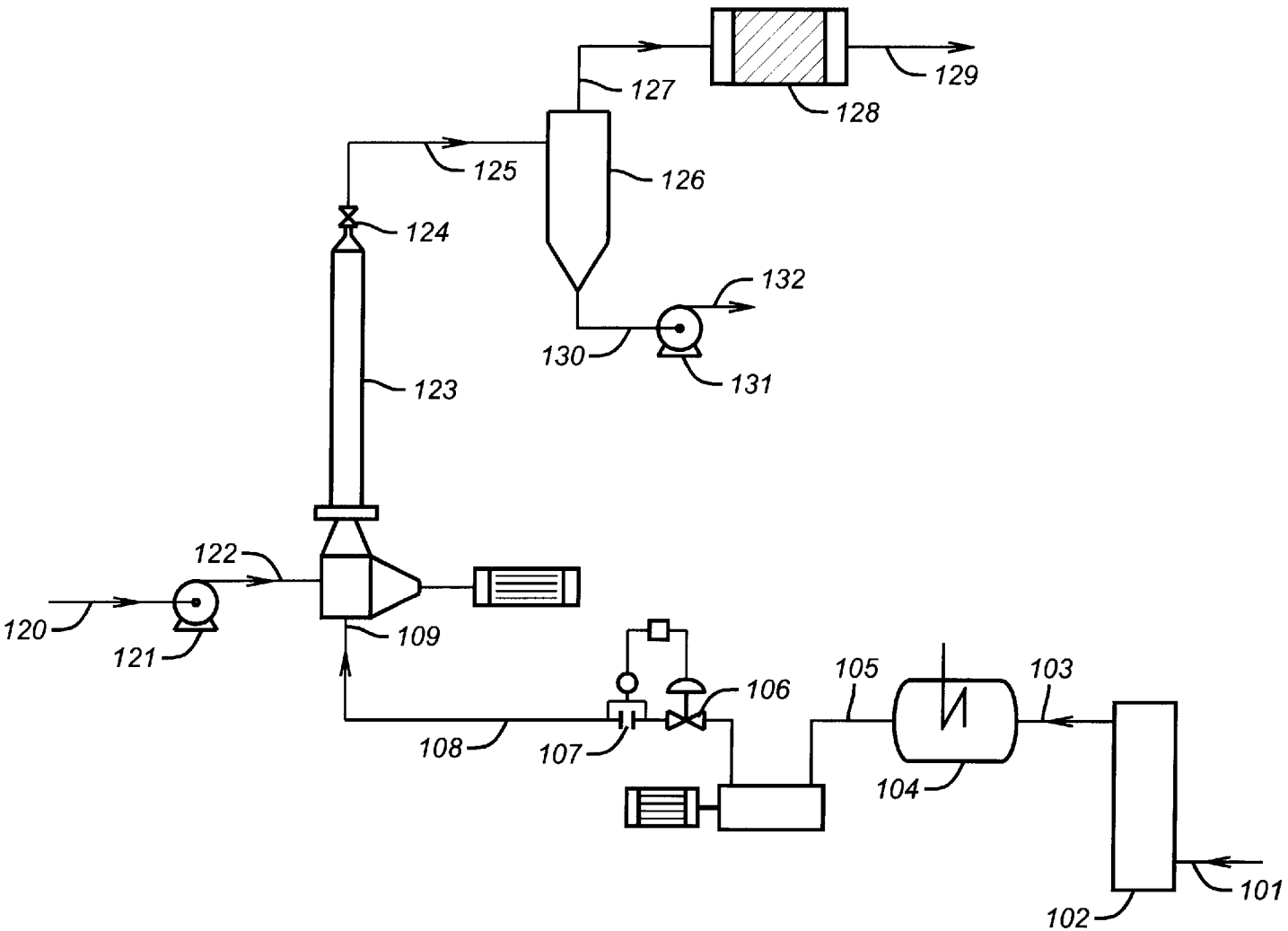
FIG. 2 of the Drawing depicts a reactor for bleaching pulp at low consistency with ozone employing an ozone compressor.

FIG. 2 illustrates a reactor for bleaching pulp at low consistency with ozone by using an ozone compressor. It comprises generally of a medium consistency mixer where ozone is dispersed in the low consistency pulp, followed by a retention tube operating at a pressure between 20–60 psig where ozone gradually dissolves and bleaches the pulp.

Air is introduced by line 100 into an air separation unit 102 where an oxygen rich stream is separated from air. Oxygen passes by line 103 into an ozone generator 104 and is converted to ozone and this passes through line 105 into an ozone compressor 110 where the gas mixture is compressed. From here it flows to a control valve 106 that automatically regulates the gas flow by gas flowmeter 107. Ozone gas is introduced to the mixer 109 by an inlet line 108 and is dispersed into the low consistency pulp. Pulp slurry passes through line 120 into pump 121 where it is pumped into the mixer 109 via line 122 and mixed with the ozone-oxygen mixture.

The pulp slurry-gas mixture passes into the column 123 that is held under pressure by a back pressure valve 124. The ozone-oxygen mixture dissolves and reacts with the pulp slurry before exiting through valve 124 into line 125. The pulp slurry-gas mixture flows into a separator vessel 126 where gases are separated from the pulp and flow through line 127 into an ozone destruct unit 128, where the ozone is destroyed and the gases leave through line 129. The pulp slurry leaves the separator through line 130 and flows into pump 131 where it is pumped to the next stage through line 132.

Figure 3:
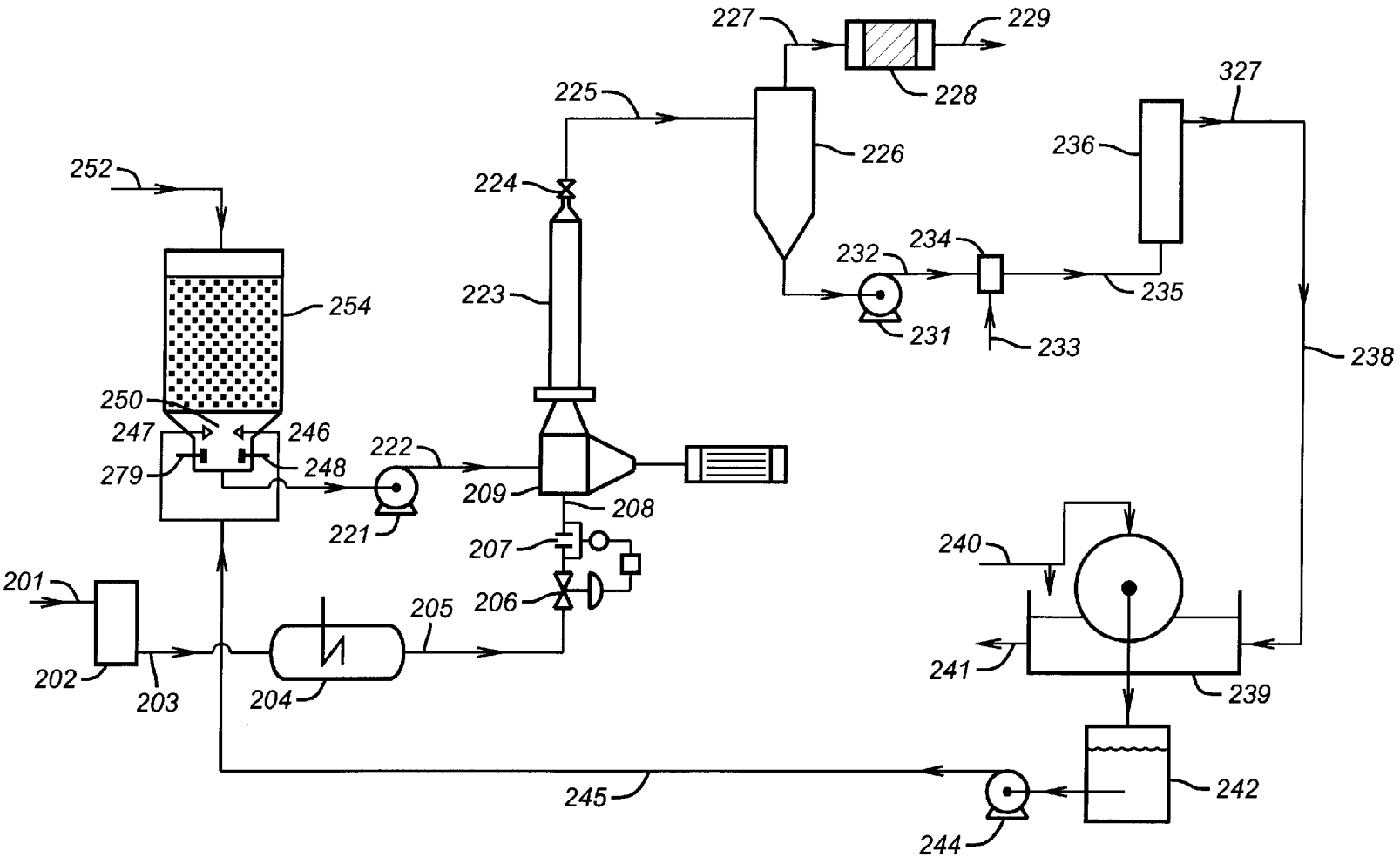
FIG. 3 of the Drawing depicts a low consistency ozone bleaching process carried out before a chlorine dioxide bleaching step.

FIG. 3 illustrates a low consistency ozone bleaching process in accordance with the present invention that includes an ozone bleaching stage before a chlorine dioxide bleaching stages. This uses a pressurized ozone generator to compress ozone before adding it to a mixer. This method avoids the use of a compressor to add compressed ozone to the mixer.

In the process, pulp of medium consistency is pumped through line 252 into a storage tank 251. The pulp flows down the tank into a dilution zone 250 where it is diluted to a low consistency with dilution water added through nozzles 246 and 247. Agitators 248 and 249 ensure that mixing is complete. The pulp slurry of consistency about 3% passes through line 220 into pump 221 where it is pumped into the mixer 209 and mixed with the ozone-oxygen mixture. Air is introduced by line 201 into an air separation unit 202 where oxygen is separated from air. Oxygen passes by line 203 into a pressurized ozone generator 204 and is converted to ozone and this oxygen-ozone mixture passes through line 205 into a control valve 206 that automatically regulates the gas flow by gas flowmeter 207. The ozone-oxygen gas mixture is introduced to the mixer 209 by an inlet line 208 and is dispersed into the low consistency pulp.

The pulp slurry-gas mixture passes into the column 223, that is held under pressure by a back pressure valve 224. The ozone-oxygen mixture dissolves and reacts with the pulp slurry before exiting through valve 224 into line 225. The pulp slurry-gas mixture flows into a separator vessel 226, where gases are separated from the pulp and flow through line 227 into an ozone destruct unit 228, where the ozone is destroyed and the resulting gases leave through line 229. The pulp slurry leaves the separator 226 through line 230 and flows into pump 231, where it is pumped through line 232 into a mixer 234 where chlorine dioxide is added through line 233 before flowing by line 235 into the bottom of the bleaching tower 236. The pulp rises to the top of the tower and overflows through line 237 into line 238 to a washer 239. The pulp is washed with wash water added through line 240 and the washed pulp leaves the washer through line 241. The dilution water separated from the pulp is collected in storage tank 242, where it is removed through line 243 by pump 244 and is pumped through line 245 to the nozzles 246 and 247, where it is added to the dilution zone 250 of the storage tank 251.

Figure 4:
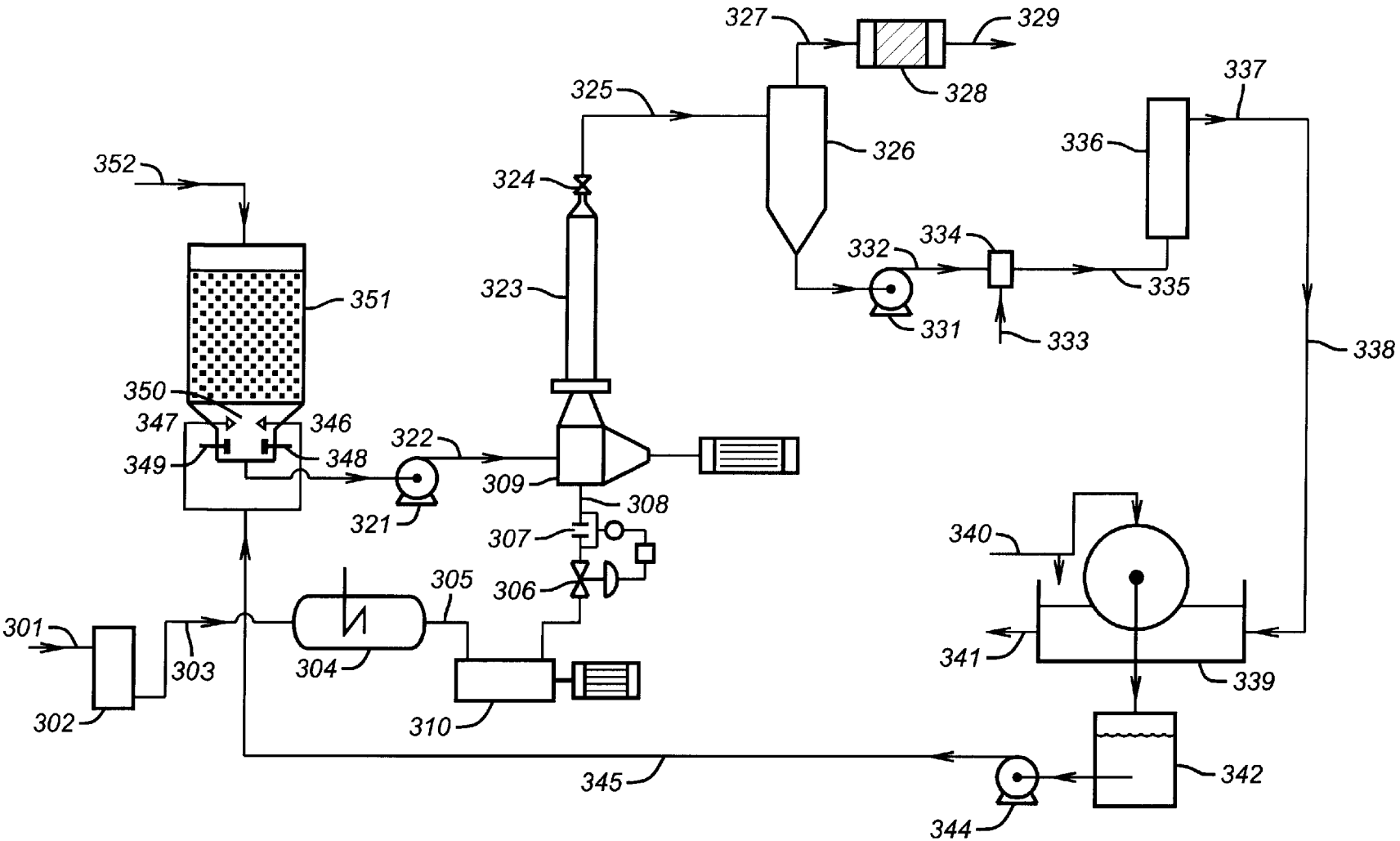
FIG. 4 of the Drawing depicts an alternative low consistency ozone bleaching process carried out before a chlorine dioxide bleaching step.

FIG. 4 illustrates a low consistency ozone bleaching process involving an ozone bleaching stage in accordance with the present invention that is carried out before a chlorine dioxide bleaching stage. The process uses a compressor to compress ozone before adding it to the mixer.

In the figure, pulp of medium consistency is pumped through line 352 into a storage tank 351. The pulp flows down the tank into a dilution zone 350 where it is diluted to a low consistency with dilution water added through nozzles 346 and 347. Agitators 348 and 349 ensure that mixing is complete. The pulp slurry of consistency about 3% passes through line 320 into pump 321 where it is pumped through line 322 into the mixer 309 and mixed with the ozone-oxygen mixture. Air is introduced by line 301 into an air separation unit 302 where oxygen is separated from air. Oxygen passes by line 303 into an ozone generator 304 and is converted to ozone, and this oxygen-ozone mixture passes through line 305 into an ozone compressor 310 where it is compressed. From here it flows to a control valve 306 that automatically regulates the gas flow by gas flowmeter 307. The ozone gas mixture is introduced to the mixer 309 by an inlet line 308 and is dispersed into the low consistency pulp.

The pulp slurry-gas mixture passes into the column 323, which is held under pressure by a back pressure valve 324. The ozone-oxygen mixture dissolves and reacts with the pulp slurry before exiting through valve 324 into line 325. The pulp slurry-gas mixture flows into a separator vessel 326 where gases are separated from the pulp and flow through line 327 into an ozone destruct unit 328, where the ozone is destroyed and the gases leave through line 329. The pulp slurry leaves the separator through line 330 and flows into pump 331 where it is pumped through line 332 into a mixer 334 where chlorine dioxide is added through line 333 before flowing by line 335 into the bottom of the bleaching tower 336. The pulp rises to the top of the tower and overflows through line 337 into line 338 to a washer 339. The pulp is washed with wash water added through line 340 and the washed pulp leaves the washer through line 341. The dilution water separated from the pulp is collected in storage tank 342. It is removed through line 343 entering pump 344 and is pumped through line 345 to the nozzles 346 and 347, where it is added to the dilution zone 350 of the storage tank 351.

Figure 5:
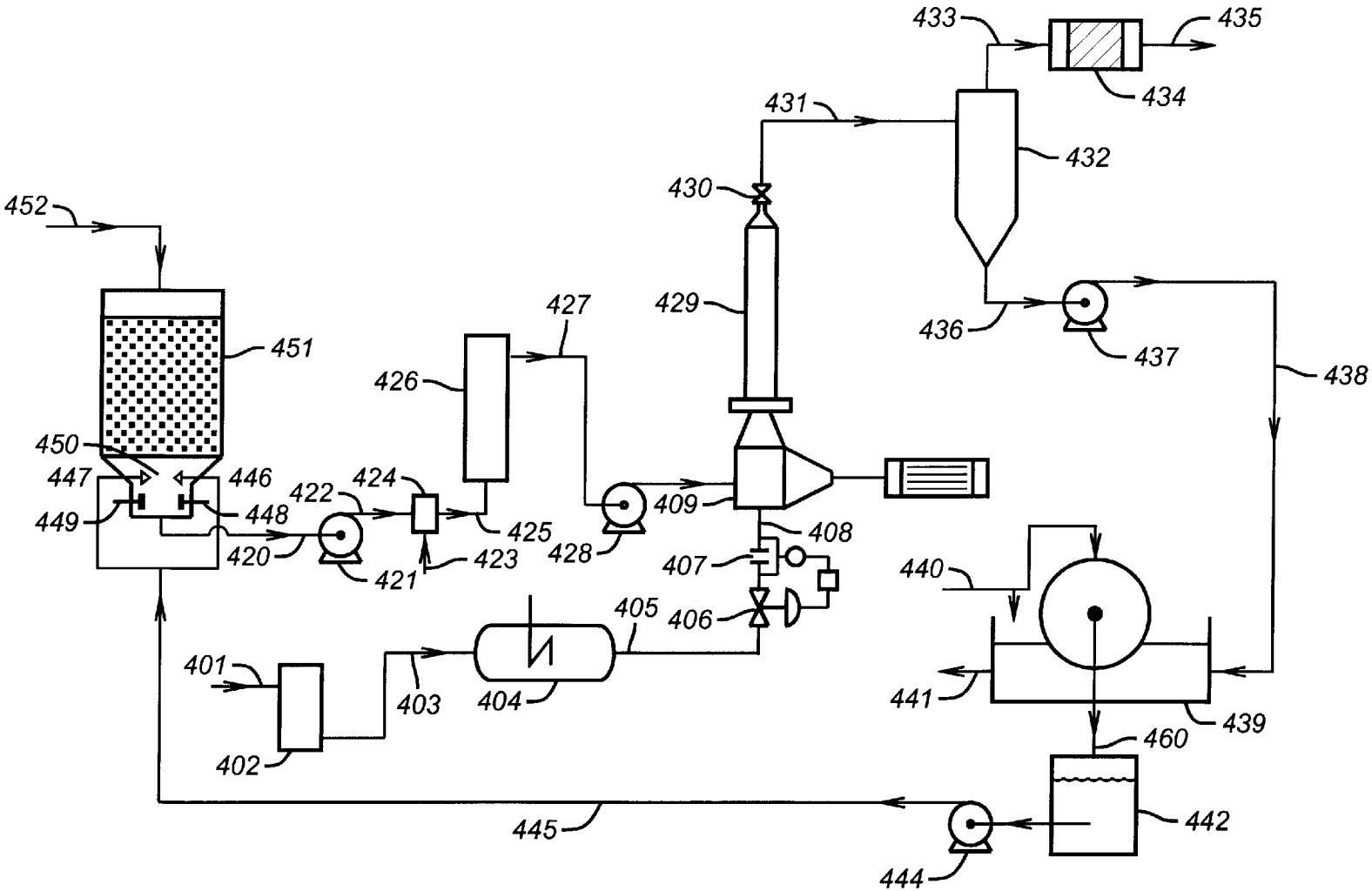
FIG. 5 of the Drawing depicts a low consistency ozone bleaching process wherein the ozone bleaching step is carried out after a chlorine dioxide bleaching step.

FIG. 5 depicts a low consistency ozone bleaching process stage in accordance with the present invention that is carried out after a chlorine dioxide bleaching stage. The process uses a pressurized ozone generator to produce compressed ozone before adding it to a mixer. This method avoids the use of a compressor to add compressed ozone to the mixer.

Pulp of medium consistency is pumped through line 452 into a storage tank 451. The pulp flows down the tank into a dilution zone 450 where it is diluted to a low consistency with dilution water added through nozzles 446 and 447. Agitators 448 and 449 ensure that mixing is complete. The pulp slurry, now of low consistency about 3%, passes through line 420 into pump 421 that discharges through line 422 into a mixer 424 where chlorine dioxide is added through line 423. The pulp slurry-chlorine dioxide mixture passes through line 425 into the bottom of tower 426, where it flows upwards consuming chlorine dioxide and bleaching the pulp. It overflows from the tower 426 in line 427 flowing into pump 428, which discharges into mixer 409 where the oxygen-ozone mixture is added.

Air is introduced by line 401 into an air separation unit 402 where oxygen is separated from air. Oxygen passes by line 403 into an ozone generator 404 and is converted to ozone and this passes through line 405 into a control valve 406 that automatically regulates the gas flow by gas flowmeter 407. Ozone gas is introduced to the mixer 409 by an inlet fine 408 and is dispersed into the low consistency pulp. The pulp slurry-gas mixture passes into the column 429, which is held under pressure by a back pressure valve 430. The ozone-oxygen mixture dissolves and reacts with the pulp slurry before exiting through valve 430 into line 431. The pulp slurry-gas mixture flows into a separator vessel 432, where gases are separated from the pulp and passed through line 433 into an ozone destruct unit 434, in which the ozone is destroyed and the resultant gases leave through line 438. The pulp slurry leaves the separator through line 436 and flows into pump 437, where it is pumped to the washer 439 through line 460. The pulp is washed with wash water added through line 440 and leaves through line 441. The washings are collected in tank 442 and leave through line 443 entering pump 444 and discharges via line 445 through nozzles 446 and 447 into the dilution zone 450 of the medium consistency storage tank 451.

Figure 6:
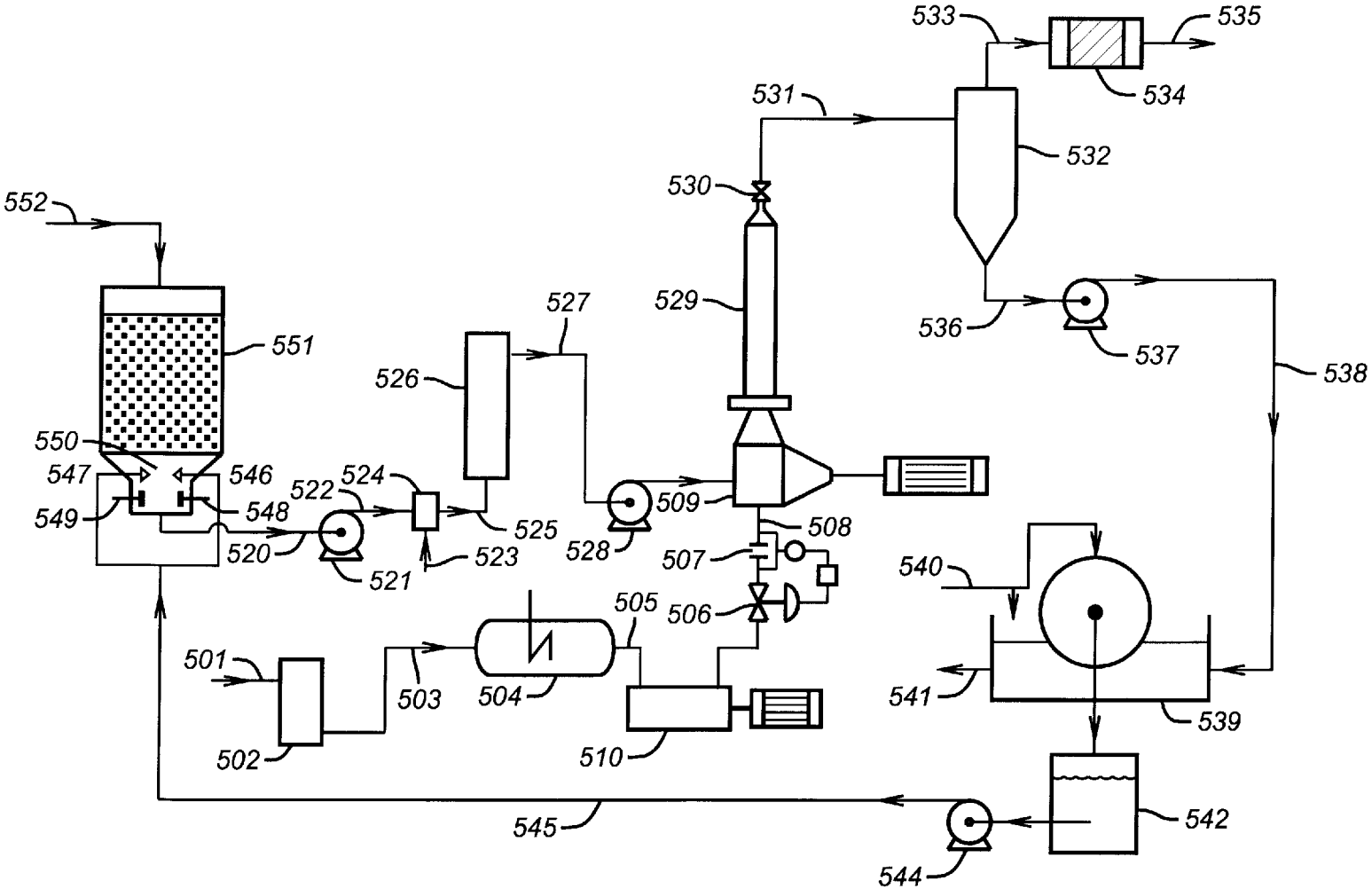
FIG. 6 of the Drawing depicts an alternative low consistency ozone bleaching process using an ozone bleaching step that is carried out after a chlorine dioxide bleaching step.

FIG. 6 illustrates a low consistency ozone bleaching process in accordance with the present invention that is carried out after a chlorine dioxide bleaching step. The process uses a compressor after the ozone generator to compress ozone before adding it to a mixer.

Pulp of medium consistency is pumped through line 552 into a storage tank 551. The pulp flows down the tank into a dilution zone 550 where it is diluted to a low consistency with dilution water added through nozzles 546 and 547. Agitators 548 and 549 ensure that mixing is complete. The pulp slurry, now of consistency about 3%, passes through line 520 into pump 521 and discharges through line 522 into a mixer 524 where chlorine dioxide is added through line 523. The pulp slurry-chlorine dioxide mixture passes through line 525 into the bottom of tower 526, where it flows upwards consuming chlorine dioxide and bleaching the pulp. It overflows from the tower in line 527 flowing into pump 528 and discharges into mixer 509 where the oxygen-ozone mixture is added. Air is introduced by line 501 into an air separation unit 502 where oxygen is separated from air. Oxygen passes by line 503 into an ozone generator 504 and is converted to ozone, and this passes through line 505 into a compressor 510 where the gas is compressed. The oxygen-ozone mixture passes through control valve 506, which automatically regulates the gas flow by gas flowmeter 507. The ozone gas mixture is introduced to the mixer 509 by an inlet line 508, and is dispersed into the low consistency pulp.

The pulp slurry-gas mixture passes into the column 529, which is held under pressure by a back pressure valve 530. The ozone-oxygen mixture dissolves and reacts with the pulp slurry before exiting through valve 530 into line 531. The pulp slurry-gas mixture flows into a separator vessel 532, where gases are separated from the pulp and flow through line 533 into an ozone destruct unit 534, wherein the ozone is destroyed and the resultant gases leave through line 535. The pulp slurry leaves the separator through line 536 and flows into pump 537 where it is pumped to the washer 539 through line 538. The pulp is washed with wash water added through line 540 and leaves through line 541. The washings are collected in tank 542 and leave through line 543 entering pump 544 and discharges via line 545 through nozzles 546 and 547 into the dilution zone 550 of the medium consistency storage tank 551.

The invention will be illustrated in greater detail by the following specific example. It is understood that the example is given by way of illustration and is not meant to limit the disclosure or the claims to follow. All percentages in the examples, and elsewhere in the specification, are by weight unless otherwise specified.

EXAMPLE 1

It has been found that most pulps bleach well giving increased brightness with little strength loss for an ozone charge of 5 kg of ozone/ton pulp. Taking this is as the basis of a design for a reactor, and assuming ozone is generated at a concentration of 12% w/w, the oxygen requirement is estimated as follows:

$O_2$ required=100*5/12=41.7 kg/ton of pulp.

This produces a mixture of $O_2$+$O_3$=5 kg $O_3$+36.7 kg $O_2$.

The volume of the gases at a pressure of 760 mms Hg, and temperature of 0° C. is 2.76 $m^3$ $O_3$+30.40 $m^3$ $O_2$.

Total gas volume=33.16 $m^3$/ton of pulp.

If this is to be dispersed and dissolved in a pulp slurry having a consistency of 3%, volume of pulp slurry=100/3 $m^3$/ton of pulp=33.3 $m^3$/ton of pulp.

This consists of 1.0 $m^3$ pulp+32.3 $m^3$ of dilution water.

Hence it is required to dissolve and disperse 33.16 $m^3$ of gas in 33.3 $m^3$ of pulp slurry.

The ratio of gas to pulp slurry=33.16:33.3=about 1:1.

If all the $O_3$ dissolved in the dilution water, the solubility of the $O_3$ would have to be 5 kg/32.3 $m^3$, or 155 g/$m^3$.

If this reaction takes place at 50° C., the solubility of 12% w/w $O_3$ in water is as follows:

| Total Pressure (psia) | Partial Pressure $O_3$ (psia) | Solubility $O_3$ (g/$m^3$) |
|---|---|---|
| 14.7 | 1.22 | 13.2 |
| 24.7 | 2.05 | 22.2 |
| 164.7 | 13.67 | 147.9 |

If this is compared to dispersing ozone in medium consistency pulp having a consistency of 10%:

Volume=1.0 $m^3$ pulp+9.0 $m^3$ dilution water=10.0 $m^3$ pulp slurry.

If 5 kg $O_3$ ton of pulp is dispersed and dissolved in the dilution water, $O_3$ applied=5 kg/9 $m^3$=555 g/$m^3$.

The gas to liquid ratio at a pressure of 760 mms Hg and 0° C. is 33.16:9, which is 3.7:1.

At a pressure of 150 psig, this ratio becomes 0.33:1

If this medium consistency equipment disperses ozone satisfactorily at a ratio of 0.33:1 for medium consistency pulp, it will be able to do the same for low consistency. Hence to reduce the gas:slurry ratio from 1:1 to 0.33, the gas volume must be reduced by a ratio of 1/0.33 $m^3$. This corresponds to a pressure of 30 psig.

Based on the above calculations, it was decided that medium consistency equipment can be used for dispersing ozone into low consistency pulp at a pressure of 30 psig. This was confirmed by testing carried out in the Laboratory as follows:

Laboratory Studies

Trials were carried out in a Quantum Mark-5 Laboratory Mixer/Reactor. This was originally designed and operated with medium consistency pulp. For each run 90 grams of pulp having Kappa No=25.5 was used and a first bleaching stage at a temperature of 40° C. with a constant chlorine dioxide dosage of 14.5 kg/ton was carried out. Following this, 4.0–5.5% w/w ozone-oxygen mixture was then introduced at a pressure of 50–70 psig at a temperature of 40° C. During the ozone addition, the pulp was mixed for 5 seconds at high intensity using a Quantum mixer followed by subsequent intermittent mixing at a lower intensity (using a CSTR) for 5 minutes. The results are shown in Table 1 below:

TABLE 1

| $O_3$ Charge (kg/t) | $O_3$ Consumed (kg/t) | $O_3$ Reacted (%) | Retention Time (mins) | Pressure (psig) |
|---|---|---|---|---|
| 2.4 | 2.2 | 93.0 | 5 | 46 |
| 4.0 | 3.9 | 95.0 | 5 | 55 |
| 6.1 | 5.8 | 95.1 | 5 | 52 |
| 7.3 | 7.0 | 95.9 | 5 | 65 |

This illustrates that equipment designed for dispersing gases in medium consistency pulp can also be used successfully for $O_3$ bleaching of low consistency pulp with high ozone utilization.

EXAMPLE 2

Tests were carried out on a Pilot Plant that was originally designed to use ozone to bleach a medium consistency pulp slurry. It consists of a pump that pumps the pulp into a pressurized high shear mixer. Ozone of concentration 12% w/w is compressed and added to the pulp slurry at the inlet of the mixer. The ozone gas mixture is dispersed in the pulp slurry where it reacts with the lignin. The slurry-gas mixture discharges into a column where the remaining ozone is consumed.

Results for a Softwood Pulp having Kappa No 31, carried out at temperature 40° C. and a pulp consistency of 3.5%, are shown in Table 2 below:

TABLE 2

| Ozone Charge to pulp (kg/t) | Ozone Pressure inlet Mixer (psig) | Pressure Bottom Tower (psig) | Ozone Consumed in Mixer (%) | Ozone Consumed top Tower (%) |
|---|---|---|---|---|
| 6.3 | 30 | 20 | 87 | 99 |
| 6-3 | 90 | 80 | 94 | 99 |
| 6-3 | 110 | 100 | 99 | 99 |

These results demonstrate that a Mixer designed for dispersing ozone into a medium consistency pulp slurry can be used successfully for a low consistency pulp slurry and that it is possible to operate at lower pressures with good results.

EXAMPLE 3

Two runs of an ozone stage were performed on a brown stock kraft pulp at low consistency in a Pilot plant using a high intensity mixer. The runs were made to verify if the ozone stage efficiency (degree of delignification) and the consumption were equivalent for low and medium consistency pulp. The pulp used was a softwood kraft with an initial kappa number of 30.8 and ISO brightness of 27.9%.

In each run, the washed pulp was received at 33% consistency and diluted to 3.8% consistency in an agitated feed tank. Pulp slurry was then preheated to 40° C. with the injection of steam in the feed tank. At that temperature, concentrated (98%) sulphuric acid was added to the tank to adjust the pH of the pulp suspension to 2.5 before the ozone stage. Pulp slurry was pumped directly to the hopper of the positive displacement pump. This pump introduced pulp in the high pressure section of the pilot plant, where ozone gas was mixed with the pulp in a Impco high intensity mixer. The flow of the pulp into the high pressure section and the ozone charge and concentration were kept constants.

After compression, the ozone gas stream was introduced into the pulp suspension trough a sintered metal sparger (20 micron porosity) located between the feed pump discharge and the Impco high intensity mixer inlet. The residence time in that mixer was approximately 0.05 second. The conditions for each run are described in Table 3.

The pulp was sampled approximately 1 meter from the ozone injector point after passing through the high intensity mixer. Gas samples were removed at the exit of the high intensity mixer, at the medium consistency pulp sampling point and at the top of the tower. Each gas sample was analyzed for residual concentration by gas chromatography. The ozonated pulp for the second run was analyzed for kappa number (CPPA standard, G.18) and ISO brightness (CPPA standard, E.1). The results are shown in Table 4 below.

The efficiency of delignification was approximately 1 kappa number drop per kg ozone. This observation is comparable to the efficiency observed at medium consistency and demonstrates the successful and efficient use of a high shear mixer with ozone and low consistency pulp.

TABLE 3

| Z-stage conditions | | |
|---|---|---|
| Conditions | First Run | Second Run |
| Consistency, % | 3.8 | 3.8 |
| Temperature, ° C. | 40 | 40 |
| pH | 2.4 | 2.4 |
| Ozone charge, % o.d. pulp | 0.551 | 0.566 |
| Ozone concentration, % | 12.85 | 13.21 |
| Pressure | 30 | 90 |
| Residence time, min | 6.4 | 6.4 |

TABLE 4

| Results | | | | |
|---|---|---|---|---|
| | First Run | | Second Run | |
| Results | Bottom | Top | Bottom | Top |
| Ozone residual, % on o.d. pulp | 0.072 | 0.001 | 0.037 | 0.001 |
| Ozone consumed, % on o.d. pulp | 0.479 | 0.550 | 0.530 | 0.565 |

TABLE 4-continued

| Results | | | | |
|---|---|---|---|---|
| | First Run | | Second Run | |
| Results | Bottom | Top | Bottom | Top |
| Kappa | | | 27.0 | 24.1 |
| Brightness ISO, % | | | 31.4 | 32.2 |
| Viscosity, CP | | | 25.3 | 23.3 |

Initial kappa: 30.8 and brightness % ISO: 27.9, 39.5 CP

EXAMPLE 4

The performance of continuously stirred tank reactors (CSTR) of different types was compared to a high shear mixer for delignification efficiency in a D/Z process at low consistency. The performances were compared on the basis of OXE (oxidation equivalent, with 1 OXE=quantity of substance which receives 1 mole electrons when the substance is reduced. $ClO_2$=74.12 OXE/Kg and $O_3$=125.00 OXE/Kg). All of the CSTRs considered were similar in setup in terms of ozone pressure, concentration and duration.

The various reactors/mixers run, with the results are as follows.

Figure 7:
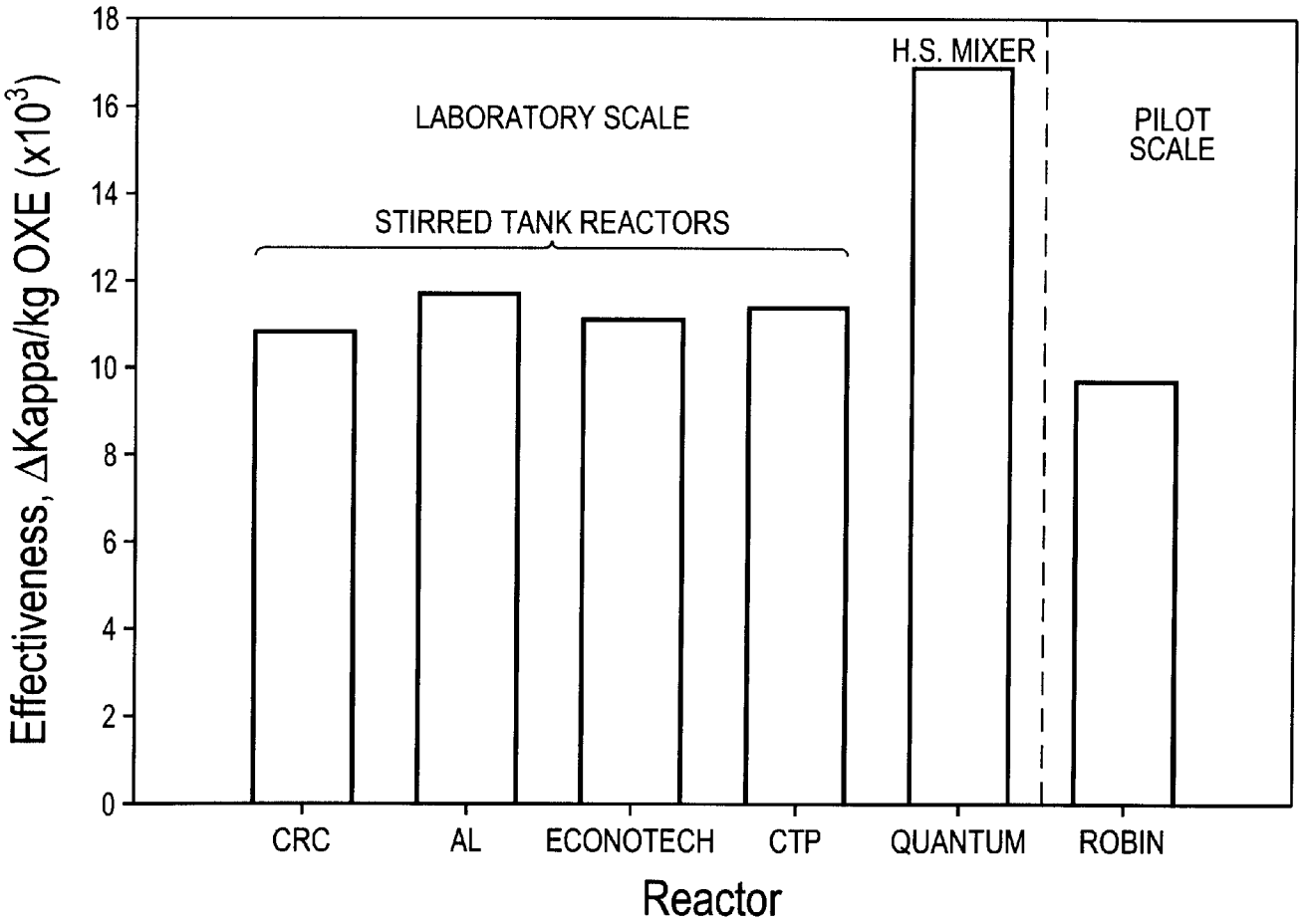
FIG. 7 of the Drawing graphically depicts the D/Z delignification efficiency for various reactor/mixers at low consistency (2.5–3.5 wt %).

CRL: (D/Z)Ep, SKP, initial kappa No. 23.3, final kappa No. 3.6, 14.0 kg $ClO_2$ ton for 6.3 kg $O_3$/ton AL: (D/Z)Eop, SKP, initial kappa No. 24.0, final kappa No. 7.9, 8.0 kg $ClO_2$/ton, 6.33 kg/$O_3$/ton ECONOTECH: (D/Z)Ep, SKP, initial kappa No. 23.3, final kappa No. 3.6, 14.0 kg $ClO_2$/ton, 6.0 kg $O_3$/ton CTP: (D/Z)Ep, SKP, initial kappa No. 25.4, final kappa No. 5.1, 15.0 kg $ClO_2$/ton, 5.3 kg $O_3$/ton QUANTUM: (D/Z)Ep, SKP, initial kappa No. 25.5, final kappa No. 4.5, 10.0 kg $ClO_2$/ton, 4.0 kg $O_3$/ton ROBIN: (D/Z)Ep, SKP, initial kappa No. 25.4, final kappa No. 9.0, 9.3 kg $ClO_2$/ton, 8.1 kg $O_3$/ton The delignification efficiency for the various reactors is graphically depicted in FIG. 7. The results clearly demonstrate the superiority of using a high shear mixer in connection with ozone at low consistency, as compared to other reactors which are conventionally used with low consistency pulp.

While the invention has been described with preferred embodiments, it is to be understood that variations and modifications may be resorted to as will be apparent to those skilled in the art. Such variations and modifications are to be considered within the purview and the scope of the claims appended hereto.

What is claimed is:

1. A process for bleaching pulp with ozone, which comprises:

preparing a slurry of cellulosic pulp having a consistency in fibers of from 1 to less than 5 weight %;

adding ozone to the cellulosic pulp under high shear mixing conditions; and maintaining the ozone in contact with the cellulosic fibers under the high shear mixing conditions for a period of time ranging from 0.01–4 seconds thereby consuming 87–99% of the ozone.

2. The process for bleaching pulp with ozone of claim 1, wherein the cellulosic fibers are subjected to a chlorine dioxide bleaching stage.

3. The process for bleaching pulp of claim 1, wherein the cellulosic pulp used to prepare the slurry is obtained from a chlorine dioxide bleaching stage.

4. The process for bleaching pulp with ozone of claim 1, wherein after expiration of the time period the cellulosic pulp and any non-consumed portion of the ozone are passed into a pressurized retention tube where the non-consumed portion of the ozone reacts with lignin in the cellulosic pulp.

5. The process for bleaching pulp of claim 4, wherein the residence time in the retention tube ranges from 1 to 10 minutes.

6. The process for bleaching pulp with ozone of claim 1, wherein the cellulosic pulp and any ozone in the retention tube not reacted with the lignin leaves the retention tube through a pressure control valve and is discharged into a separate vessel, where the any ozone not reacted with the lignin in the retention tube is passed into an ozone destruct unit and thereafter vented to the atmosphere, and the cellulosic pulp from the retention tube is passed to a subsequent bleaching stage.

7. The process for bleaching pulp of claim 6, wherein the subsequent bleaching stage involves chlorine dioxide as the bleaching agent.

8. The process for bleaching pulp of claim 1, wherein the ozone used in the process is generated on-site from oxygen in a pressurized ozone generator.

9. The process for bleaching pulp of claim 8, in which the ozone generator produces ozone from oxygen at a concentration in the range of 10–20%.

10. The process for bleaching pulp of claim 9, wherein the ozone generator operates at a pressure in the range of from about 20–60 psig.

11. The process for bleaching pulp with ozone of claim 1, wherein the ozone charge added to the pulp is in the range of from about 2–10 kg/ton of pulp.

12. The process for bleaching pulp of claim 11, wherein the ozone charge added to the pulp is in the range of from about 5–6 kg/ton of pulp.

13. The process for bleaching pulp of claim 1, wherein the pulp slurry consistency is in the range of from 3–4 weight %.

14. The process for bleaching pulp of claim 1, wherein the ozone is maintained in contact with the cellulosic fibers under the high shear mixing conditions for a time period ranging from 0.1 to 4 seconds.

15. The process for bleaching pulp of claim 1, wherein the temperature of the pulp slurry entering the mixing with ozone is in the range of from 20 to 80° C.

16. The process of claim 1, wherein the cellulosic fibers are passed to a retention tube after expiration of the time period.

17. The process of claim 1, wherein the ozone is added directly to the cellulosic pulp under high shear mixing conditions.

18. The process of claim 1, wherein the ozone is maintained in contact with the cellulosic fibers under the high shear mixing conditions for a period of time ranging from 0.01 to 0.1 seconds.

* * * * *